United States Patent [19]

Hunt et al.

[11] 4,291,619

[45] Sep. 29, 1981

[54] SCREW PRESS WITH CONTROLLABLE REAR DOOR

[76] Inventors: Arthur J. Hunt; Arthur J. Hunt, Jr., both of 332 N. Halifax Dr., Orlando, Fla. 32704

[21] Appl. No.: 85,492

[22] Filed: Oct. 17, 1979

[51] Int. Cl.[3] ..... B30B 9/12

[52] U.S. Cl. ..... 100/43; 100/98 R; 100/117; 100/147

[58] Field of Search ..... 100/98 R, 117, 147, 100/148, 149, 150, 43, 37, 126, 127, 128, 129, 112, 95

[56] References Cited

U.S. PATENT DOCUMENTS

| | | | |
|---|---|---|---|
| 2,340,009 | 1/1944 | Meakin | 100/147 X |
| 3,085,502 | 4/1963 | Hurtig | 100/147 X |
| 3,111,082 | 11/1963 | Larsson | 100/147 |
| 3,982,483 | 9/1976 | Bird | 100/148 |
| 4,117,776 | 10/1978 | Hunt | 100/117 |

FOREIGN PATENT DOCUMENTS

| | | | |
|---|---|---|---|
| 272248 | 6/1971 | U.S.S.R. | 100/127 |

*Primary Examiner*—Billy J. Wilhite

*Attorney, Agent, or Firm*—Duckworth, Hobby, Allen, Dyer & Pettis

[57] ABSTRACT

A screw press for extracting liquids from materials such as fruits, vegetables, or the like having a cylindrical barrel and a rotatable shaft and helical feed and compression screw concentric with the barrel and having the shaft extending through the barrel. A portion of the barrel rearward from the feed and compression screw forms a cylindrical pressing chamber having screen walls for passing extracted liquids therethrough. The outlet end of the cylindrical pressing chamber is closed by a circular door slidably mounted on the drive shaft. Hydraulic actuators apply adjustable pressure to the outside surface of the door closing the chamber when in a non-operating condition. When material is being pressed in the pressing chamber, the internal pressure will overcome the external pressure causing the door to open for ejection of the dried material. The inner surface of the door includes projecting cutter bars. A clutch coupled to the door and the rotating drive shaft automatically engages when the door opens to cause the door to rotate and the cutting bars to pare away a cake of dried material which forms in the pressing chamber. The hydraulic pressure is adjustable to control the door opening pressure and therefore the percentage of liquid extracted from the materials being pressed. The feed and compression screw is driven by an adjustable drive system to permit control for optimum throughput of the press.

4 Claims, 6 Drawing Figures

SCREW PRESS WITH CONTROLLABLE REAR DOOR

BACKGROUND OF THE INVENTION

1. Field of the Invention

The present invention relates to screw presses for extracting liquid from fruits or vegetables or the like, and more particularly to a screw press for extracting the remainder of the liquids in such fruits and vegetables after predraining or prepressing.

2. Description of the Prior Art

Screw presses have been widely used for the extraction of liquids from solids or semi-solids in the food industry. A primary application of such presses is in the grape and wine industry. Our co-pending U.S. patent application Ser. Nos. 69,110 and 69,174, are for a screw press which may be utilized as a predrainer for removing free run juice from destemmed grapes. The disclosed predrainer press will advantageously remove about 80% of the available juice from the grape must. Thus, the must from the predrainer is relatively dry. Prior art screw presses have difficulty in handling very dry materials. Most such screw presses utilize a large forward pitch feed and pressing screw extending for approximately half the length of the press barrel. The remainder of the barrel is open with a closed door disposed at its outer end. Material introduced into the first thread flights of the feed screw are carried forward and build up in the chamber formed by the open section of the press and the closed door. As more and more material accumulates, a cake is built up within this region with the force from the feed screw threads forcing the cake against the end door. Various door designs have been used; however, a restraining force or back pressure must be applied to the door allowing it to open only when the pressure of the cake exceeds such back pressure. Once the cake is built up and material continued to be fed into such presses, the liquids are squeezed out of the cake of material and passed through screens which normally form the walls of the press barrel. These liquids are collected for further processing. The material forced out of the door as it opens is then collected as waste.

Prior art presses have generally used top-hinged doors and have had difficulties in applying the required back pressure once the door has been forced completely open. An improved door structure in a screw press of this type is disclosed in U.S. Pat. No. 4,117,776 to Hunt which uses a flat surface circular door which can open by sliding horizontally on a shaft concentric with the press barrel with back pressure being maintained on the door by means of a coil spring. The door incorporates cutter bars on its inside surface and a mechanical friction clutch for engaging the door with the shaft which is turning with the feed screw. Thus, when the back pressure of the spring is overcome by the force of the cake, the door opens by sliding back, engaging the clutch and rotating to cut away the cake exiting through the door opening. While superior to the hinged doors, the door construction disclosed in this patent has the disadvantage of not being readily adjustable. As will be discussed hereinafter the operator of a press must be able to control the back pressure of the door if various types of fruit and materials are to be completely dewatered.

When a run is completed with the press of the Hunt patent, the barrel and the feed screw must be cleaned.

To this end, the feed screw, feed screw drive shaft, and the door are mounted on a carriage such that the feed screw may be completely withdrawn from the barrel for cleaning. This arrangement is relatively complex and expensive.

Most prior art presses are relatively slow to build up the cake in the pressing chamber, and additives such as paper straw and the like are commonly introduced to more quickly build the cake but at added expense and reduction in efficiency of liquid extraction. Our present invention is a screw press especially suitable for predrained or relatively dry materials and which overcomes the above noted problems in the equipment of the prior art.

SUMMARY OF THE INVENTION

The present invention is a screw press type liquid extractor especially adapted for final pressing of predrained grapes, and similar fruit. The screw press represents an improvement over the screw press section of the Hunt U.S. Pat. No. 4,117,776. The press utilizes an elongate cylindrical barrel or cage divided into a feed and pressure section and a pressing chamber section. The walls of the pressing chamber section and of a portion of the feed and pressure section are formed from a filter screen or the like through which extracted liquids can pass. The feed and compression screw is formed from a cylindrical body having large pitch spiral threads attached thereto and disposed in the feed and pressure section of the press barrel. A concentric drive shaft through the screw body is utilized to turn the feed screw via a hydraulic drive unit. The front portion of the feed and pressure section is an enclosed inlet region with an inlet opening at the top thereof to allow gravity feed of materials into the press.

A circular door is disposed at the end of the pressing chamber, having tapered edges mating with an opening in the chamber and bulkhead. The circular door is slidably engaged with the feed and pressure screw drive shaft which extends through the door and is supported at its outer end by a bearing frame or pillow block. External inward pressure on the door will therefore maintain the door tightly closed until outward pressure from inside the chamber overcomes the external pressure and forces the door to slide rearward along the drive shaft. In order to effectively press or squeeze the material in the pressing chamber, it is necessary to maintain a desired pressure against the outside of the door, and it is important that the operator of the press be able to accurately control this pressure to provide a uniform percentage of liquid extraction since various different materials may require different pressures. A novel hydraulic pressure system is utilized having hydraulic actuators attached to the rear frame of the press with their actuating rods applying pressure to the rear door through a throw-out type bearing assembly. Hydraulic pressure is applied to the hydraulic actuator pistons in a direction to force the rods outward. An adjustable pressure relief valve is connected between the inlet and outlet lines of the hydraulic actuators settable to relieve at a selected pressure above that applied to the actuators. Thus, when the pressure of the material in the pressing section of the barrel against the inner surface of the door exceeds the hydraulic pressure such that the relief valve bypasses, the door will be forced backward along the drive shaft allowing the material to extrude out of the opening in the rear plate in the form of a highly compressed plug or log. The door also includes a plurality of cutter bars attached and projecting from its inside surface. As the door is opened by the internal pressure, a clutch switch is mechanically closed causing an electric clutch anchored to the drive shaft and to the door to engage, rotating door at the speed of the drive shaft. The cutters then pare away the compressed plug or log which builds up in the pressing section during operation, allowing the chips to be collected and carried away.

In operation, the material to be dewatered is introduced into the inlet opening of the press and into the first flight of the feed screw. When first starting up, the incoming material is quickly carried along the feed screw, which may be rotating at 5 to 60 rpm, and into the pressing chamber. The inlet is designed to prevent slippage of the incoming materials and the feed screw can quickly fill the pressing chamber. As the pressing chamber becomes filled, additional material forced rearward will begin compressing the material forming a plug or cake in the pressing section. As the cake is formed, the pressure squeezes the liquid from the material which liquid passes through the screens and is collected in pans beneath the screw press. After a solid cake is formed, the pressure produced by the feed screw continues to build up with liquids being squeezed from the cake by both the wiping action of the face of the screw threads against the cake and the compression of the material within the cake. When the pressure increases to the point that the rear door is forced rearward against the hydraulic pressure, engaging the clutch, the rotation of the rear door with its cutter blades turning at the same rotational speed as the screw feed will continuously pare away the cake, allowing incoming material to replace the ejected portion. This action will be continuous as long as the inlet is maintained with a sufficient head of material. The dryness of the ejected cake, which is indicative of the percentage of remaining liquid removed from the incoming material, is controlled by the pressure at which the rear door opens, and is thus controllable by the operator through adjustment of the hydraulic pressure. Such pressures can be predetermined for various types of materials to be pressed. The pressure may also be controlled by the rate of rotation of the feed screw, providing an additional variable to optimize the throughput for specific material. The rate of rotation is also adjusted to maintain a desired head of material in a hopper above the inlet opening.

It is desirable in wine making and other liquid extraction systems to minimize the amount of solids in the juices. In wine making, the destemming operation generally introduces a significant amount of solids which can appear in the juice. It is therefore important that the pressing operation does not add appreciably to these solids to minimize time and expense in separating the juice from the solids. The screen of the mesh may be selected to provide some filtering action with respect to solids; however, a tendency of solids to clog the screens must be avoided. It is also important after a run to be able to easily and efficiently clean the filter screens. Additionally, it is desirable to be able to change filter screens for the optimum filter mesh design for the variety of grape or the type of fruit being processed. In prior art machines, disassembly of the screens has been necessary to accomplish such changes. In accordance with our invention, we have provided a hinging structure in which screens can be very easily and quickly cleaned and the press made ready for the next run. Similarly, the hinging method permits easy interchange of screens when desired.

The filter screens of the invention comprise a pair of semicircular sections of a cylindrical cage having a screen frame consisting of a plurality of circumferential ribs arranged to support the screens. The screen frames thus represent halves of a cylinder with attachment strips along the outer edges. A pivot shaft is disposed parallel with the drive shaft of the feed screw having a series of interleaved hinge blocks pivoted thereto. The two cage sections are attached at the bottom to the interleaved hinge blocks which form offset hinges such that opening of the two screen cage sections causes the sections to move downward and outward, completely clear of the feed screw. The screen halves are normally secured at the top when the unit is in operation. When cleaning is required, the bolts holding the top edges of the screen sections together are removed and the two halves opened. At this point, the inner surfaces of the screens are readily accessible for rinsing, scrubbing and cleaning, as is the feed screw, door and cutters. The screens are attached to the screen frames by attachment strips fastened to the frame edges. With the screens in the open position, the screens are readily removable and replaceable.

The preferred drive system for the invention utilizes a hydraulic system powered from an electric motor. The drive motor for the feed screw is therefore a hydraulic unit with control of the hydraulic pressure utilized to provide speed control. Thus, the electric motor serves only to operate the hydraulic pump to provide hydraulic pressure. Advantageously, the hydraulic motor transfers this energy at constant torque regardless of the speed. The hydraulic system also furnishes pressure for the end door pressure assembly.

It is therefore a principal object of the invention to provide a screw type press particularly suitable for use as a final press for extracting available juice from fruit, vegetables, and the like.

It is another object of the invention to provide a screw type press for removing the remainder of usable juice from grapes or the like which have been predrained to remove free run juice.

It is still another object of the invention to provide a screw type pressure having an inlet opening matched to the pitch of the feed screw to thereby eliminate slipping of wet input material and to provide positive feed of such material through the press.

It is still another object of the invention to provide a screw press having the above features in which the speed of rotation of the feed screw is adjustable to permit maintaining a preselected head of material in a hopper above the inlet.

It is a further object of the invention to provide a screw type press having filter cages hinged for complete opening thereof for cleaning and interchange of screens without dismantling of the cages.

It is still a further object of the invention to provide a screw type press having a hydraulic drive system which will transfer energy at constant torque for various rotational speeds.

These and other objects and advantages of the invention may be determined from the detailed description below when read in conjunction with the attached drawings.

DETAILED DESCRIPTION OF THE PREFERRED EMBODIMENT

Figure 1:
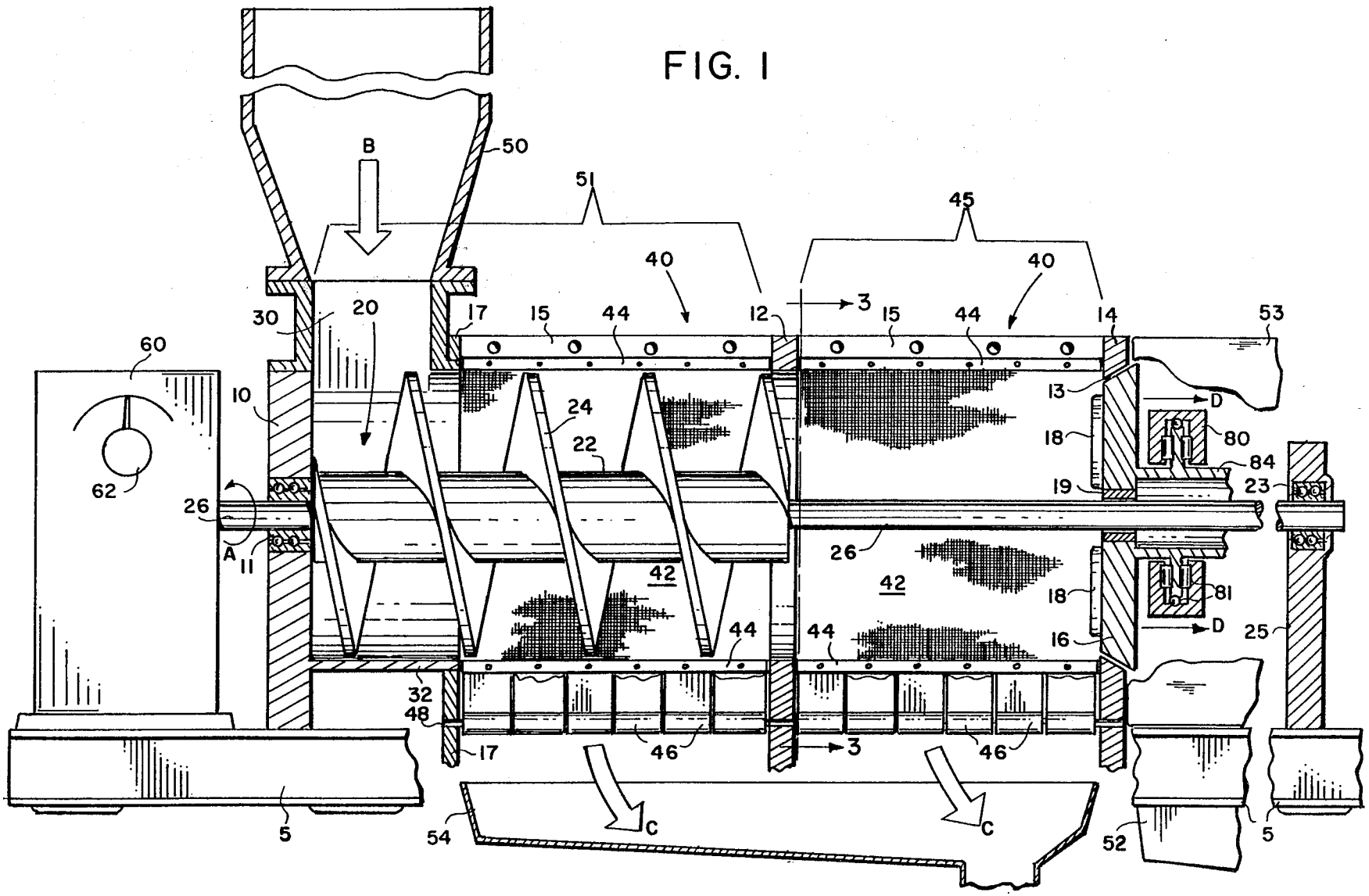
FIG. 1 is a cross-sectional view of the frame of the invention showing the feed and pressure screw and the pressing chamber, with details of the clutch and hydraulic pressure assembly omitted.

Referring first to FIG. 1, a longitudinal cross-section of the preferred embodiment of the screw press is shown. The framework of the screw press consists of four transverse bulkheads mounted on a bed or base 5: front bulkhead 10 having a front bearing 11 mounted therethrough for shaft 26; rear bulkhead 14 having a tapered opening 13; inlet bulkhead 17 utilized to support inlet housing 32 between front bulkhead 10 and inlet bulkhead 17; and intermediate bulkhead 12 provided between inlet bulkhead 17 and rear bulkhead 14 serving to divide a cage section shown generally at 40 into a front feed section 51 and a rear pressing chamber 45. Cage section 40 is formed by screen frames 41 (see FIG. 2) consisting of a series of circumferential ribs 49 supporting stainless steel screens 42 which form the inner walls of cage 40. Details of the cage construction are discussed below. Thus, the essentially cylindrical inlet housing 32 and cage section 40 form an elongated cylinder housing a feed and pressure screw shown generally at 20. Screw 20 consists of a cylindrical base or body portion 22 mounted to and concentric with drive shaft 26 as may be noted in FIG. 3. Spiral threads 24 are affixed to the surface of body portion 22 and have an outside diameter with sufficient clearance to turn within the walls of the cage 40 and inlet housing 32 without interference therewith. The pitch and diameter of spiral threads 24, the diameter of body portion 22, and the length of the press are parameters which may be selected in accordance with the material to be pressed, the characteristics of the liquids to be expressed, the volumes of material to be handled, and the throughout required. For example, we prefer a 12 inch pitch feed screw for final pressing of grapes and similar fruit and an overall length of 8 feet for the press barrel. Thus, with the barrel or cage lengths shown in FIG. 1, about $3\frac{1}{2}$ threads are present in the feed portion of the cage with about the same length of cage for the pressing chamber portion. We have found this ratio of feed length to pressing chamber length particularly effective. A rear circular door 16 having tapered edges fits tapered opening 13 of rear bulkhead 14. As described in more detail below, external pressure is utilized to hold door 16 closed against the pressure created by feed and pressure screw 20.

As shaft 26 is rotated in the direction shown by the arrow A, material in the spaces between threads 24 will tend to be moved longitudinally along the press and deposited in pressing chamber 45. Assuming that the flights between threads 24 and pressing chamber 45 are essentially filled with material, it may be noted that material will be gradually reduced in volume by continuing pressure of screw 20 against door 16. Therefore, liquid contained in the material will be squeezed out and will pass through screens 42 between the ribs 49. Such liquids will be collected by pan 54 in the base 5 and may be withdrawn via an outlet as shown by solid arrows C. AS may be seen in FIG. 2, stainless steel covers 56 are used over bulkheads 17, 12 and 14, extending down and connecting to base 5 to prevent loss of liquids and to direct such liquids into pan 54. As the liquid is removed from the material and the pressure increases, door 16 will open as indicated by arrows D, causing the remainder to be extruded through the opening 13 in rear bulkhead 14 and ultimately into collector 52 for disposal as shown by solid arrows F in FIG. 5. Feed and pressure screw 20 is driven via shaft 26 from a hydraulic drive unit 60 which includes a manually variable speed control indicated at 62. While the rotational speed of feed screw 20 is a design parameter and may be selected in accordance with the materials to be pressed and the desired throughput, we prefer to utilize a range of 5 to 60 rpm which is eminently suitable for extracting juice from grapes.

When utilizing the press of the invention with grapes or similar fruits which tend to be slippery when wet, problems are encountered in prior art screw presses in obtaining positive feeds. The wet mass of such fruit tends to slip at the inlet portion of the press with a resulting reduction in throughput. To overcome this problem, we have determined optimum parameters of inlet section 32 an inlet throat 30. In accordance with our invention, the longitudinal length of the opening of inlet throat 30 is limited to not more than 1.5 times the pitch of spiral screw threads 24, and it is also necessary that inlet housing 32 enclose the lower portion of threads 24 to at least half of their circumference. For most applications, however, we prefer about 75% of the circumference enclosed. As the fruit, such as grape must, is fed into hopper 50, the must will enter through inlet throat 30 as shown by solid arrow B and flow into the totally enclosed region of inlet housing 32. As feed screw 20 rotates, any tendency of the must to slip rather than to be carried by the threads 24 and body 22 is essentially prevented. As a portion of the must is carried into the completely enclosed circumference beyond the throat 30, a pumping or suction effect results operative on the following must and a continuous flow of must along the press results, assuming that the must in hopper 50 is maintained at an appropriate level. In some instances where the must is very wet, the operator may run shaft 26 at a higher than normal speed to assist in start of the feed; however, as soon as positive feed begins, the pumping and suction effect is self sustaining in accordance with the invention.

Figure 4:
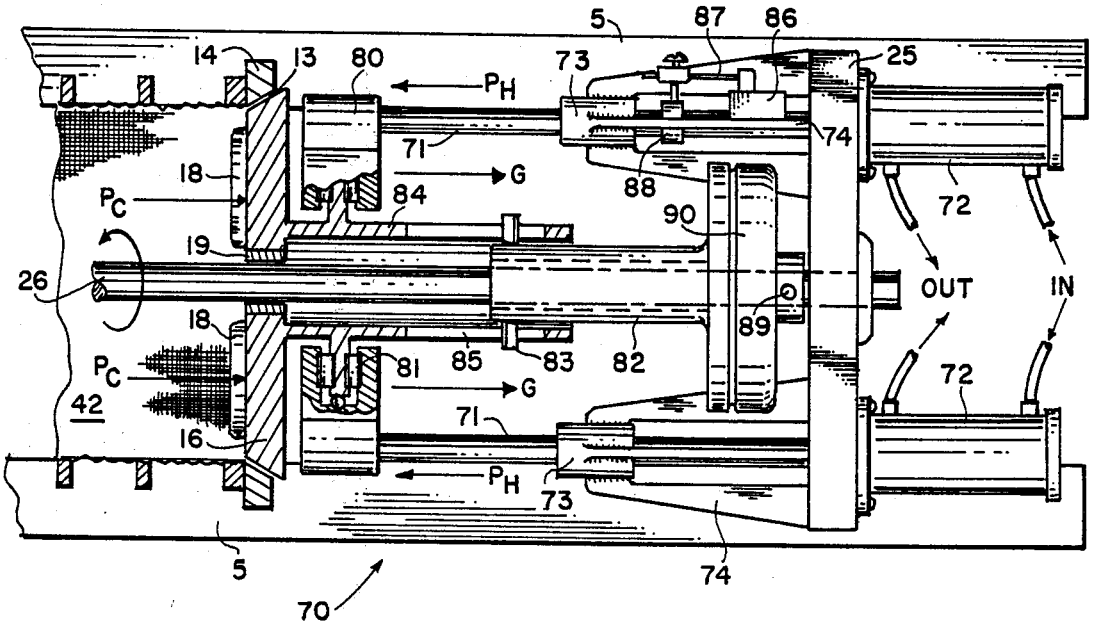
FIG. 4 is a top view of the door pressure system with the pressing chamber shown in cross-sectional view.

Referring to rear door 16 in FIG. 1, it may be noted that shaft 26 projects through bushing 19 extending rearward and supported in bearing 13 in rear frame 25. Thus, shaft 26 can rotate with respect to door 16. With no material present in the press, door 16 is maintained in the closed position by a hydraulic system 70 omitted from FIG. 1 but shown in top view in FIG. 4. Door 16 includes a rearward projecting drive tube 84 having a coupling to throw-out bearing assembly 80 and slots 85 engaged with clutch tube 82 by pins 83. Throw-out bearing assembly may include thrust roller bearings and ball bearings 81 (best seen in the cross-sectional view of FIG. 1). As shown in FIG. 4, hydraulic actuators 72 are mounted on rear frame 25 with their actuator rods 71 attached to throw-out bearing 80. With hydraulic pressure applied to actuators 72 through their inlet lines as shown, pressure is maintained on door 16 as shown, by arrows $P_H$. Actuator rods 71 are supported by support bushings 73.

Figure 5:
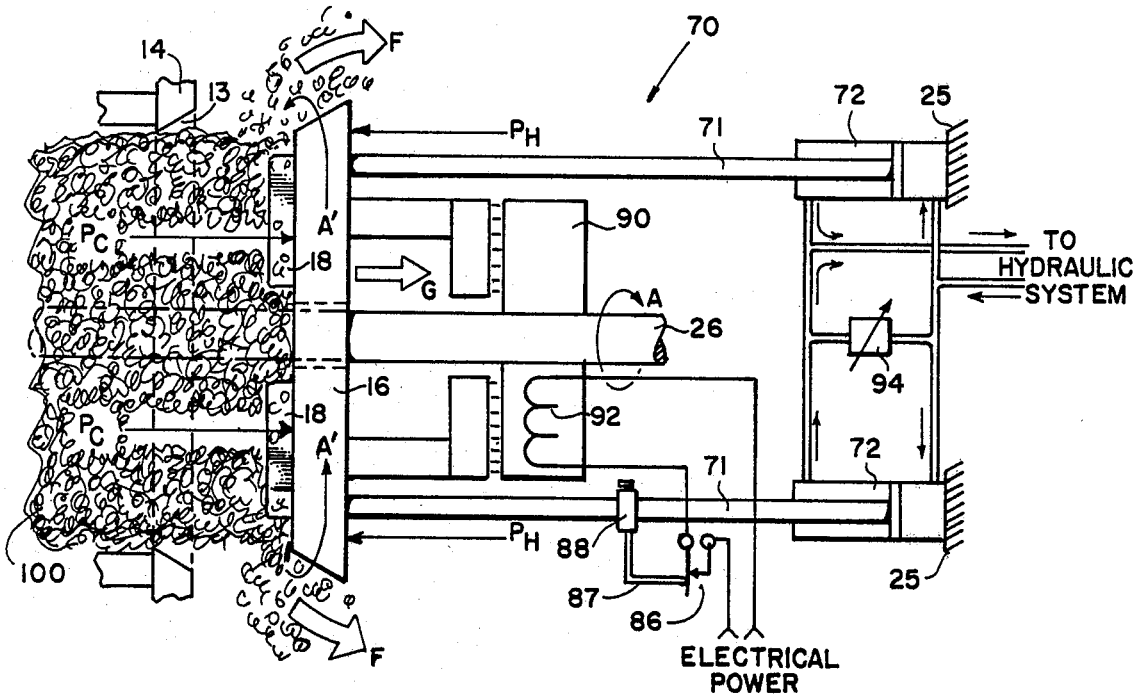
FIG. 5 is a schematic diagram of the hydraulic door pressure system and clutch system.

As shown in the schematic diagram of the clutch and hydraulic system of FIG. 5, a relief valve 94 is connected in parallel with actuators 72. When the build-up of cake pressure $P_C$ in pressing chamber 45 becomes sufficient to overcome pressure $P_H$ from the hydraulic system, door 16 will be forced rearward as shown by arrow G. Electric clutch 90 has one side pinned to shaft 26 by pin 89 and the other connected to drive tube 82. When disengaged, shaft 26 rotates freely with respect to door 16. A clutch switch 86 is mounted on support bracket 7 and operated by arm 87 clamped to switch actuator rod 71 by clamp 88. Thus, a rearward movement of door 16 closes switch 86, engaging clutch 90. Clutch drive tube 82 then rotates door drive tube 84 at the rotational speed of shaft 26 for assisting in ejection of waste material from pressing chamber 45 as described below. As may be noted in FIG. 4, door drive tube 84 is coupled to clutch drive tube 82 by means of pins 83 in tube 82 slidably engaged with slots 85 in door drive tube 84 with the lengths of slots 85 selected for the amount of door opening desired. The amount of door opening before engagement of clutch 90 may be adjusted by moving switch rod clamp 88 along actuator rod 71 thereby varying the point at which switch 86 closes. Turning to FIG. 5, a simplified schematic diagram of the hydraulic pressure and clutch system is shown with door 16 in its open position. Cake pressure $P_C$ has exceeded hydraulic pressure $P_H$, valve 94 has relieved, allowing door 16 to move outward, and switch arm 87 has closed switch 86. Magnet coils 92 in electrical clutch 90 are energized causing door 16 to rotate in the direction of A as indicated by the arrows. Cake 100 is extruded out and its face chipped away by cutters 18 as shown by solid arrows F.

Having hereinabove explained the basic functional elements of the screw press of our invention, the operation will be explained with reference to a typical application. As previously mentioned, in the wine industry free run juice or liquid generated during destemming operations is required to be removed from the must before final pressing. When using the predrainer described in co-pending patent application Ser. Nos. 69,110 and 69,174, the must can be predrained of approximately 80% of the total available juice. The predrained must is thus significantly drier than possible with prior art settling tanks and drag screens. The must from the predrainer is fed into hopper 50 as shown by solid arrow B in FIG. 1. The must enters inlet housing 32 via throat 30 and the operator sets the desired feed and pressure screw speed by control 62. This speed is predetermined for particular varieties of grapes such that the ejected must at F (FIG. 5) has been pressed to achieve a practical dryness representing essentially all of the usable juice. The required speed of rotation is also affected by the must head in hopper 50. If insufficient head is present, difficulty is encountered in maintaining positive feed. Therefore, it is desirable to have a flow rate from the predrainer sufficient to maintain an optimum head. If the velocity is too high such that the head is lost, only partial feeding occurs, and the flights are not completely filled. Thus, the must will travel rapidly through the press, will be only partially pressed, and will be ejected with excessive juice remaining. As may be seen, the operator can readily maintain the predrainer at its optimum throughput by observing the head in hopper 50 and adjusting speed control 62 to compensate for variations in the head.

At start-up, the operator may run feed and pressure screw 20 at high speed to more quickly fill the pressing chamber and produce the required cake. With a feed screw pitch of 12" and a press length of about eight feet, we have been able to build the cake in about five minutes. When the chamber is full, continuing feed compresses the must into a hard, firm cake forcing the remaining juices outward through screens 42 between ribs 49 which is then connected in pan 54. After the cake is formed in chamber 45, all of the interior of the feed and pressure screw 20 region of the press is effective in dejuicing the must. The must after leaving the first feed flight is pressed or squeezed as it is being forced by the screw 20 against the screens and the cake. New must is being fed from the inlet through the relatively small volume of the screw flights to replace the slower moving cake material. The cake is forced out of the rear door 16 mainly by the wipe or thrust of the pitch of the last screw flight. As the must in the screw thread flights also becomes packed, a wiping action between the screw faces and the cake occurs, greatly assisting in expression of the juice.

Figure 3:
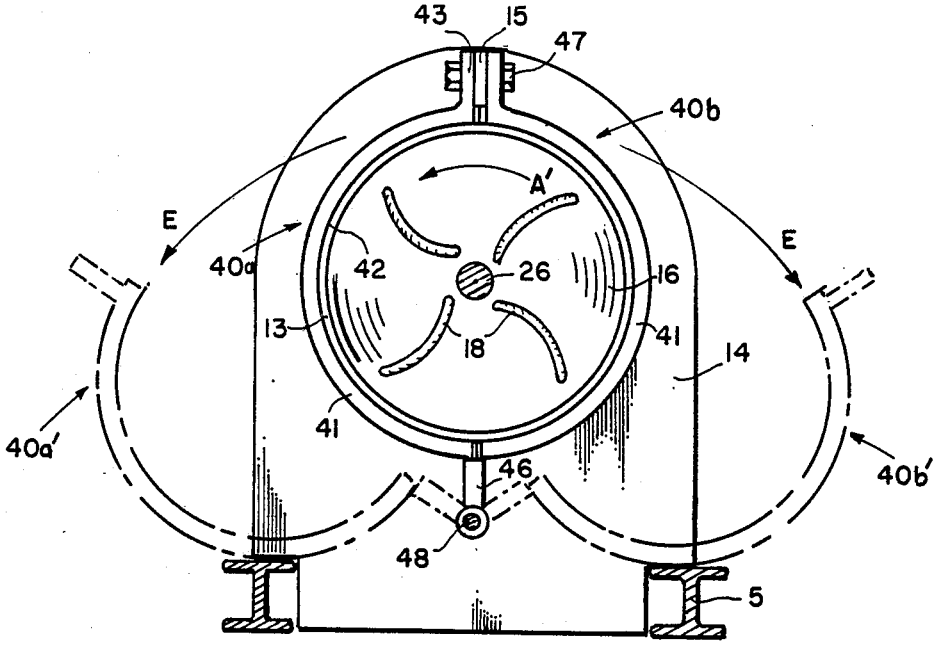
FIG. 3 is a lateral cross-sectional view of the filter screen cage showing its open position in phantom view and the rear door with projecting cutters.

It is necessary to expell the dried cake after all of the available juice is removed. As previously mentioned, the pressure of the cake due to feed and pressure screw 20 overcomes the hydraulic pressure against door 16, allowing the cylindrical shaped cake to be ejected or extruded through opening 13. Door 16 has a plurality of cutter blades 18 projecting from its inner surface. We have found that the optimum configuration for blades 18 is as shown in FIG. 3 having an arcuate shape with the convex face moving in the direction of rotation A'. A preferred cross sectional contour of blades 18 has smoothly rounded corners to prevent embeddment in the cake face as has been found to occur with sharp edge blades. The projection of blades 18 may be 1½ inches or less depending on the material to be pressed with ½ inch being preferred for pressing of most grapes. As door 16 opens, clutch 90 engages causing door 16 to rotate with shaft 26. Cutter blades 18 therefore act against the extruding cake to pare or crumble away the dry material which is allowed to drop into collector 52 as waste material. As the cake is disposed of, additional cake is extruded and more must enters inlet 30. Thus, the operation is essentially continuous. The operator may vary the feed screw drive speed within limits to assure a head is maintained in the inlet hopper 50. Periodically, the ejected must may be tested for dryness. As may be recognized, an optimum throughput versus remaining liquid may be determined experimentally for various types of varieties of grapes, the the optimum pressures and feed rates noted for future use.

Figure 2:
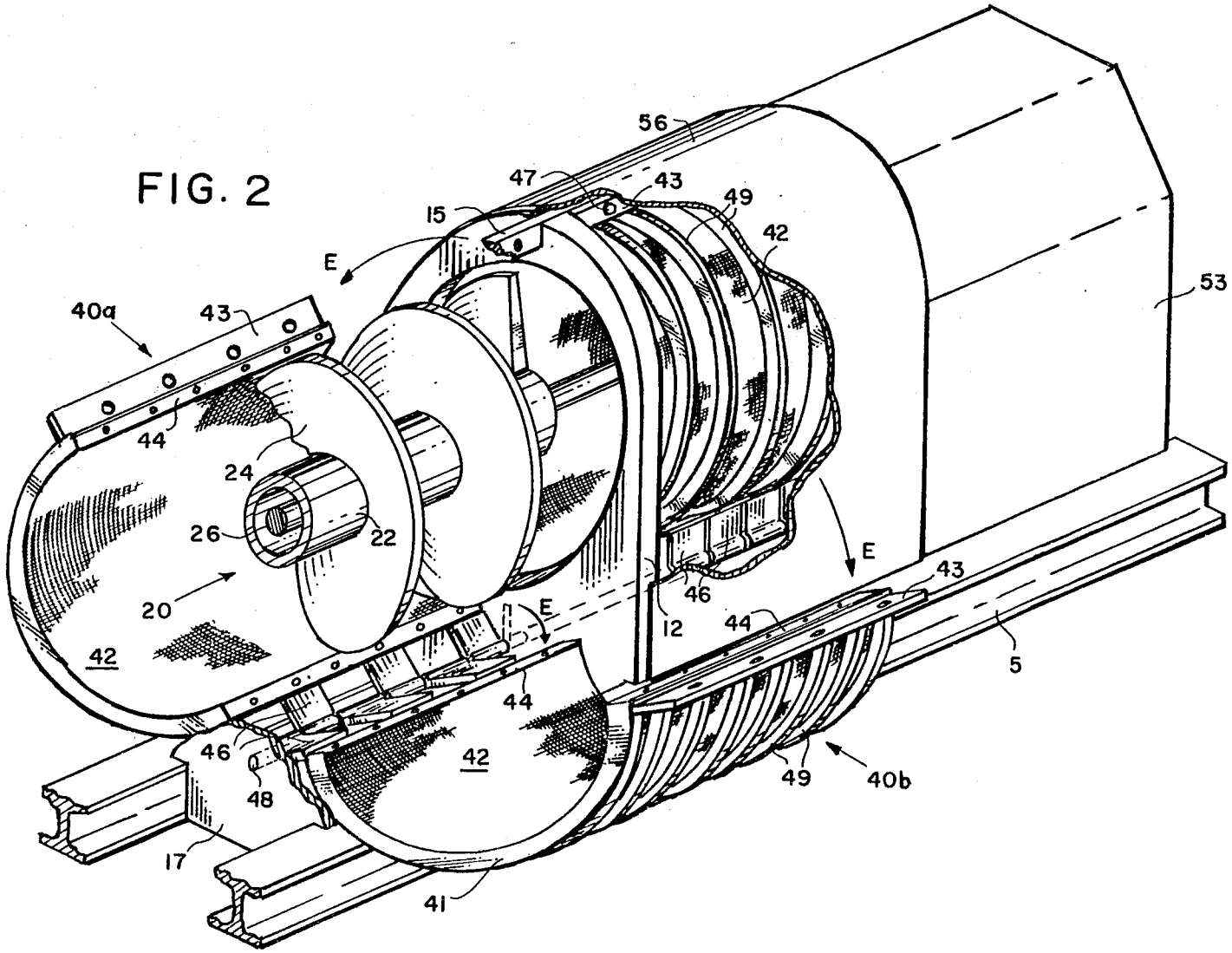
FIG. 2 is a partial perspective view of the screw press showing one filter screen cage section in its normal operating position via a cutaway view and another cage section in its open position for cleaning or changing of screens.

Turning now to FIG. 2, certain aspects of our invention will be described which greatly simplify day to day maintenance of the press, and provide flexibility of applications. FIG. 2 is a partial perspective view of the press of the invention with certain parts omitted and others cut away for clarity. The improvements disclosed are in reference to screen cage 40. The rear section of the press between intermediate bulkhead 12 and rear bulkhead 14 is shown in operating condition with stainless steel cover 56 partially cutaway to reveal the exterior of cage 40. The forward cage section 40 is shown with cover 56 removed and cage 40*a, b* opened for cleaning or screen replacement. As may be noted, cage 40 comprises two semi-cylindrical sections thereof hinged at their lower edges. When in the closed or operating condition as noted with respect to the rear section, the two halves are joined to screen frame mounting bar 15 through mounting strips 43 with bolts 47. To open the screen cage, bolts 47 are removed and the screen sections opened in a book-like fashion. In order to completely clear feed screw 20, the hinges are formed by hinge extension blocks 46 and pivot shaft 48. As may be noted, hinge extension blocks 46 extend the pivot line a short distance below the cage 40 so that the cage halves 40*a* and 40*b* move downward and outward when opened as shown by arrows E. This design advantageously completely exposes the inner wall surfaces of screens 42 to allow rinsing, scrubbing, and otherwise cleaning of the mesh. If the press is to be next used with a different material or a different variety of fruit requiring a different mesh size or type, screens 42 may be easily changed by removing the screws holding screen attachment strips 44 to frame 41. New screens with the required mesh design may then be readily re-installed. While a variety of screen materials may be used dependent upon the material to be pressed, we prefer material known as KLEENSLOT screen manufactured by WEDGE-WIRE Corporation which is available in a wide variety of meshes and designs. The novel cage design also permits ease of cleaning of feed screw 20 since all areas of the feed screw are readily accessible when the cages 40 are in their open position. Thus, very little down time is required for the press of the invention for cleaning of the screens and feed screw prior to another run.

The preferred arrangement of cage 40 is shown in additional detail in the cross sectional view of FIG. 3 which also shows the shape of cutter blades 18. Rear bulkhead 14 is indicated with rear cage 40 formed by cage halves 40*a* and 40*b* in their normal closed position. Offset hinge 46 is pivoted on pivot shaft 48 and cage sections 40*a* and 40*b* are fixed to longitudinal top brace 15 by mounting strips 43 and bolts 47. By removing of bolts 47, cage 40*a, b* may be swung open, as at E to the position of sections 40*a'* and 40*b'* shown in phantom view. Rear door 16 is seen having arcuate cutter blades 18 disposed on its face. As previously mentioned, engagement of clutch 90 when door 16 opens causes door 16 to rotate in the direction A' to cutaway the extruded cake 100 as shown in FIG. 5. The convex shape of blades 18 has been found to produce an efficient cutting action.

Figure 6:
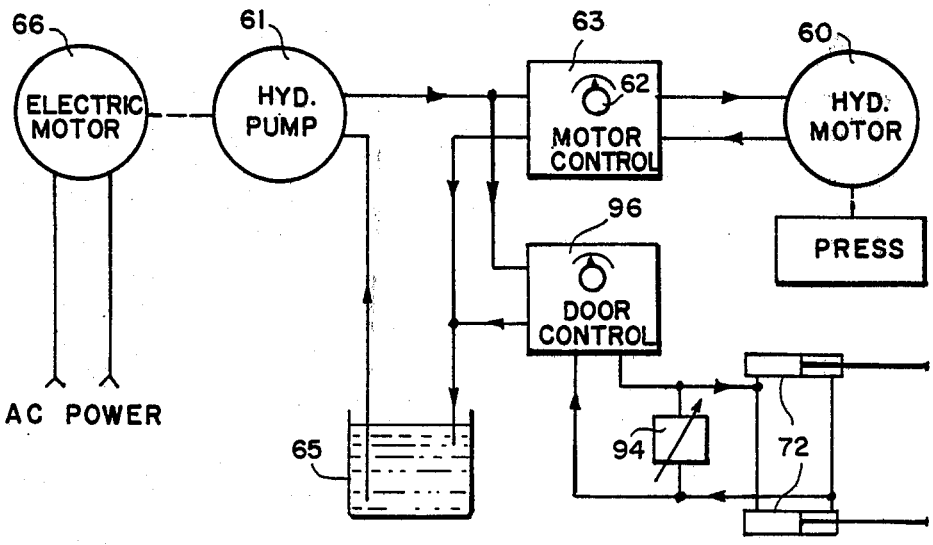
FIG. 6 is a greatly simplified schematic diagram of the power system of the invention.

As previously described, we prefer to use a hydraulic drive unit for powering the press. FIG. 6 shows generally a greatly simplified block diagram of the drive system. Basically, electric motor 66 is utilized to drive hydraulic pump 61 with reservoir 65 providing hydraulic fluid. Hydraulic drive unit 60 includes a hydraulic motor with motor speed control 63 controlled by knob 62. The primary advantage of the hydraulic drive system is that constant torque is provided over the normal range of speed variation of the hydraulic motor. The hydraulic pressure from pump 61 is used to operate hydraulic door pressure system 70 with pressure control 96 utilized by the operator to control the door pressure. Pressure relief or bypass valve 94 may be adjusted to suit a selected operating pressure.

Although a specific embodiment of our invention has been described for exemplary purposes, we are not to be limited to the details shown. For example, a hydraulic or mechanical clutch may be used rather than the preferred electrical clutch. Variations in size and capacity of the press may be made, and many other modifications will be obvious to those of ordinary skill in the art and will not depart from the spirit and scope of our invention.

I claim:

1. In a screw press for extracting liquids from materials such as fruits, vegetables, or the like having a frame, a cylindrical feed chamber and pressing chamber, said pressing chamber having screen walls for passing extracted liquids therethrough, a rotating drive shaft extending through and concentric with said chambers, and a helical feed and compression screw concentric with said shaft and disposed ahead of said compression chamber for compressing said materials against said screen walls of said chamber, the improvement comprising:

a circular door disposed at the outlet end of said cylindrical pressing chamber for closing said chamber prior to a pressing operation, said circular door slidably engaged with said drive shaft;

controllable pressure-producing means externally connected to said circular door for maintaining said door in a closed condition until outward pressure from inside said pressing chamber exceeds a preselected external pressure from said pressure-producing means;

cutter bars attached to the inside surface of said circular door;

electrically operated clutch means connected to the outside surface of said door and to said rotating drive shaft, said clutch means being disengaged when said door is in its closed position; and clutch operating means responsive to opening said door for engaging said clutch means to cause said shaft to rotate said door wherein said cutter bars rotate to pare away a cake of dried materials forced out of said pressing chamber when said door is opened.

2. The press as defined in claim 1 in which said clutch operating means is an electric switch adjustably connected to said door and adapted to close when said door opens to a preselected position.

3. The press as defined in claim 1 in which said cutter bars are attached radially with respect to the center of said circular door and are curved to present a radially convex face in the direction of rotation of said door.

4. The improvement in a screw press as defined in claim 3 in which said cutter bars have the cutting edges thereof rounded for prevention of jamming while paring of said cake.

* * * * *